US012601077B2

(12) United States Patent
Halim et al.

(10) Patent No.: US 12,601,077 B2
(45) Date of Patent: Apr. 14, 2026

(54) NICKEL EXTRACTING METHOD

(71) Applicant: Baniql, San Jose, CA (US)

(72) Inventors: Willy Sandi Halim, San Jose, CA (US); Eric Cristian Januar, Fremont, CA (US); Steven Selverston, San Jose, CA (US); Aristotle Vergara, Newark, CA (US); Xiaoliang Lin, San Francisco, CA (US)

(73) Assignee: BANIQL, San Jose, CA (US)

( * ) Notice: Subject to any disclaimer, the term of this patent is extended or adjusted under 35 U.S.C. 154(b) by 836 days.

(21) Appl. No.: 17/877,806

(22) Filed: Jul. 29, 2022

(65) Prior Publication Data

US 2023/0212770 A1 Jul. 6, 2023

Related U.S. Application Data

(60) Provisional application No. 63/296,017, filed on Jan. 3, 2022.

(51) Int. Cl.
*C25C 1/08* (2006.01)
*C25C 7/02* (2006.01)

(52) U.S. Cl.
CPC . *C25C 1/08* (2013.01); *C25C 7/02* (2013.01)

(58) Field of Classification Search
CPC ..... C25C 1/08
See application file for complete search history.

(56) References Cited

U.S. PATENT DOCUMENTS

| | | | |
|---|---|---|---|
| 4,789,444 | A | 12/1988 | Watanabe |
| 5,670,035 | A | 9/1997 | Virnig |
| 10,260,127 | B2 | 4/2019 | Duyvesteyn |
| 10,662,503 | B2 | 5/2020 | Vaughan |
| 2006/0002835 | A1 | 1/2006 | Neudorf |
| 2016/0045841 | A1 | 2/2016 | Kaplan |

*Primary Examiner* — Ciel P Contreras

(57) ABSTRACT

The present invention provides an extracting method of extracting nickel from laterite minerals. The extracting method comprises steps of gathering laterite minerals, placing electrodes into a solution, heating the solution to 75 degrees Celsius, placing the electrodes within the solution, applying a constant current, shutting off the current, filtering the solution, pouring an alkaline solution into the solution, cooling down the solution at room temperature, cooling down the solution to 0 degrees Celsius, filtering the solution, and immersing the electrodes into the solution, adding additional materials to the solution.

20 Claims, 4 Drawing Sheets

NICKEL EXTRACTING METHOD

FIELD OF THE INVENTION

The present invention relates generally to a process for extracting nickel. More specifically, the present invention is a method for extracting nickel and other metals from laterite minerals that reduces operating costs, capital costs, and energy needs making it sager, greener and faster.

BACKGROUND OF THE INVENTION

Across various industries mining and extracting metals are very important to obtain the necessary raw materials to create various products. Throughout the years nickel has been an important metal that has been used in making coins, stainless steel, and within the plating industry. In more recent times nickel has become much more important for its industrial applications due to its good ductility and its energy storage application in batteries due to its high energy density. Further, nickel alloys have a high resistance to corrosion and can withstand various temperature extremes. Due to much of modern technology being heavily dependent on nickel, the demand for nickel has rose considerably. This has resulted in the increase in extracting nickel from various minerals. The conventional process for extracting nickel from various minerals requires a high pressure around 750 psi and a high temperature around 255 degrees Celsius. This conventional process results in high operating costs, high capital costs, high energy needs, high maintenance costs due to corrosion issues and is not environmentally friendly.

An objective of the present invention is to provide users with method for extracting nickel, to reduce operating, capital, CO2 emissions and energy costs. The present invention intends to provide users with a process that extracts nickel from various laterite minerals. In order to accomplish that, a preferred embodiment of the present invention comprises a acid electroleaching step, a selective acid precipitation step, and a nickel electrowinning step. Thus, the present invention is a method for extracting nickel and other metals from laterite minerals while reducing the operating costs, capital costs, energy costs and while creating a more environmentally friendly solution.

SUMMARY OF THE INVENTION

The present invention is a method for extracting nickel from laterite minerals. The present invention seeks to provide users with a process that is more efficient than the conventional nickel extraction process. In order to accomplish this the present invention comprises an acid electroleaching step, an acid precipitation step, and a nickel electrowinning step. Further, the three steps are conducted in sequential order. Thus, the present invention is a method for extracting nickel and other metals from laterite minerals while reducing the operating costs, capital costs, energy costs and while creating a more environmentally friendly solution.

DETAIL DESCRIPTIONS OF THE INVENTION

All illustrations of the drawings are for the purpose of describing selected versions of the present invention and are not intended to limit the scope of the present invention.

Figure 1:
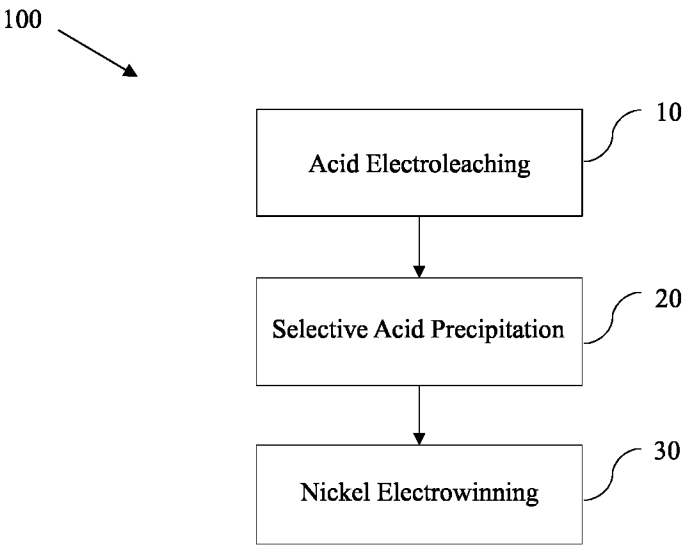
FIG. 1 is a flow diagram of one embodiment of the present invention.

As shown in FIG. 1, the present invention is three step process for extracting nickel from laterite minerals. An objective of the present invention is to provide users with method for extracting nickel and other metals in a more efficient process compared to the conventional extraction process.

The present invention intends to provide users with an extracting method 100 that reduces operating costs, capital costs and energy costs. To accomplish this the present invention comprises an acid electroleaching step 10 that runs a current through the solution. Next the selective acid precipitation step 20 allows the liquid and solid contents to be separated. Finally, the nickel electrowinning step 30 allows for recovery through reduction of nickel metals while the rest of the solution is evaporated to yield nickel salts Thus, the present invention is a method for extracting nickel and other metals from laterite minerals while reducing the operating costs, capital costs, energy costs and while creating a more environmentally friendly solution.

Figure 2:
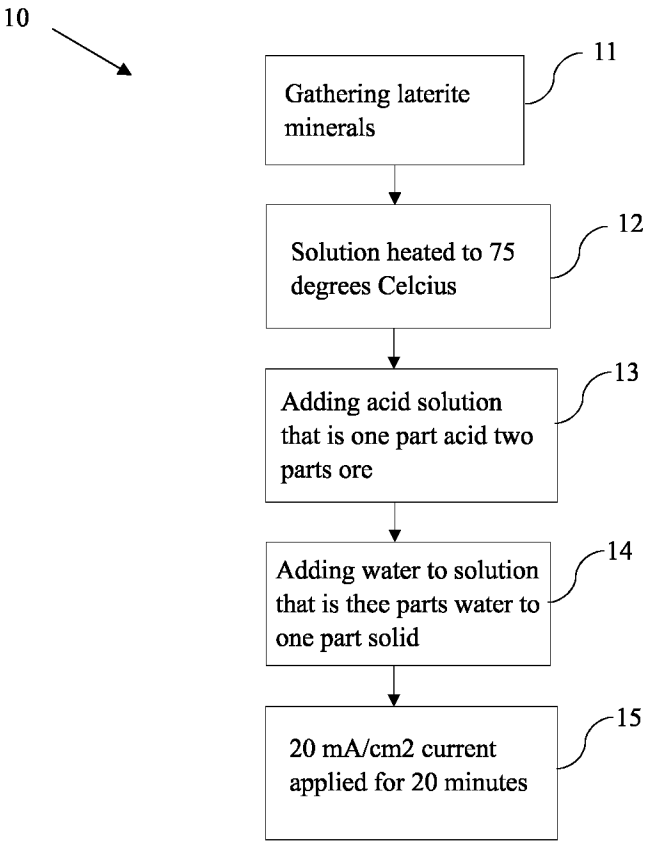
FIG. 2 is a flow diagram of one embodiment of an acid electroleaching step of the present invention.

Turning to FIG. 2, FIG. 2 is a simplified flow diagram illustrating one example of the acid electroleaching step 10 of the present invention. At 11, the acid electroleaching starts by gathering laterite minerals that comprises 1.9% Ni, 25% Fe, 0.05% Co, 3.4% Al, 2.7% Cr, 18% Mg, and 34% Si.

At 12, the acid mixture is then heated to 75 degrees Celsius. The acid solution can be one or a mixture of: sulfuric acid, hydrochloric acid and nitric acid.

In some embodiments, adding oxidizers such as hydrogen peroxide will enhance the kinetics of the dissolution.

In its preferred embodiment the electroleaching process utilizes a DC current source and places an anode and cathode into the acid mixture including an added acid solution that is one part acid and two part ore at 13 in FIG. 2) and water at a 3 to 1 liquid to solid ratio (at 14 FIG. 2).

Following is a table 1 comparing regular leaching with acid electrolysis leaching.

TABLE 1

| Element | Concentration [mg/L] | Element | Concentration [mg/L] |
|---|---|---|---|
| Na | 0.1 | Na | <0.1 |
| Mg | 0.4 | Mg | 14 |
| Al | 0.03 | Al | 1.2 |
| Ca | <0.1 | Ca | 0.1 |
| Cr | 0.02 | Cr | 1.0 |
| Fe | 0.3 | Fe | 9.7 |
| Co | <0.01 | Co | 0.05 |
| Ni | 0.08 | Ni | 2.5 |
| | Regular Leaching | | Acid Electrolysis Leaching |

Further, as the laterite mineral interacts with the solution the temperature increases by 40 degrees Celsius as a result of an exothermic reaction.

In one embodiment, one of the electrodes can be made of a stainless-steel material and the other electrode can be made with a platinized titanium material or multi-metal oxide with Ir—Ta coating. Once both electrodes are placed within the small beaker of the solution, at 15, a constant current of around 20 mA/cm2 is applied for approximately 20 minutes to enhance the dissolution rate. Finally, the current is shut off and the solution cools down before the selective acid precipitation step 20 resulting in a higher element concentration. It should be further noted that, the acid electroleaching process can be performed in many ways and the acid mixture can be created with many variations while still staying within the scope of the present invention.

Figure 3:
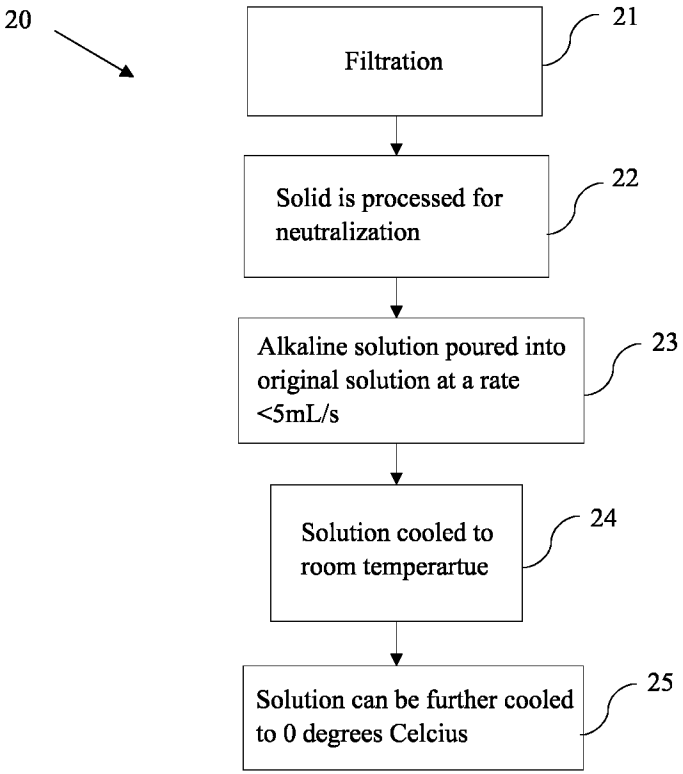
FIG. 3 is a flow diagram of one embodiment of a selective acid precipitation of the present invention.

Turning to FIG. 3, FIG. 3 is a simplified flow diagram illustrating one example of the selective acid precipitation step 20 of the present invention. The selective acid precipitation step 20 starts once the acid electroleaching step 10 has finished.

In its preferred embodiment the selective acid precipitation step 20 performs a Filtration, at 21, for solid liquid separation. The solid is then processed for neutralization at 22 while the liquid is processed for selective acid precipitation as seen in FIG. 3. An alkaline solution from (10-50% NaOH or CaOH) and combination of carbonate solution (calcium carbonate, sodium carbonate) until the pH is around 2.5-3.5 can be included in the present invention. Then it is stirred while cooled at room temperature for 1 hour. To ensure the nickel does not precipitate with the other metals the alkaline solution is poured at a rate no greater than 5 mL/s at 23.

The neutralization at 22 may involve the combination of carbonate solution and dilute hydrogen peroxide (1.75%) and bring the pH of the solution to 3.5 at 55° C.

A neutralization agent can be a combination of alkaline, carbonate, and hydrogen peroxide.

In one embodiment, before pouring the alkaline solution, the laterite is wetted with dilute hydrogen peroxide (1.75% content) at 1:1 (laterite and dilute peroxide) ratio Then the wetted laterite is mixed with the sulfuric acid to bring up temperature to 150° C. due to a highly exothermic reaction.

Once the alkaline solution had been mixed with the original solution the solution is then cooled to room temperature at 24. The solution can then be further cooled to 0 degrees Celsius at 25 to enhance the precipitation rate of the solids and allow the nickel to float within the solution.

Figure 4:
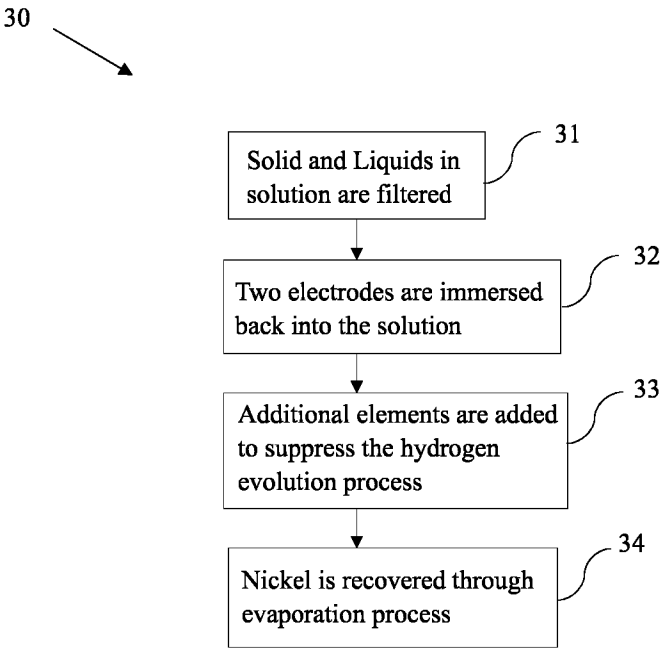
FIG. 4 is a flow diagram of one embodiment of a nickel electrowinning step of the present invention.

Turning to FIG. 4, FIG. 4 is a simplified flow diagram illustrating one example of the selective acid precipitation step 30 of the present invention. The Nickel electrowinning step 30 starts once the selective acid precipitation step 20 is complete.

In its preferred embodiment the Nickel electrowinning process 30 starts with another filtration method for the solid and liquid contents at 31. The solid within the solution is mainly composed of Fe and Cr, and the liquid is mainly composed of Nickel, cobalt, manganese, sodium, and calcium after the selective acid precipitation step 20 is complete. Then, at 32, two electrodes are then immersed back into the solution for electrowinning. Between the nickel and the rest of the metals there is a large reduction potential, resulting in a high selectivity on Nickle plating on the cathode. Further, the anode is composed of a platinized titanium mesh. In an alternative embodiment the anode can be designed with a multi-metal oxide and suppressant salts. Then, at 33, bismuth, cadmium, indium, tin, lead, ammonium chloride, boric acid and mercury are added to the solution or plated on the stainless steel/tin/or Nickel cathode on the cathode to suppress the hydrogen evolution reaction. Finally, the Nickel is recovered by scraping the metal out of the cathode, at 34.

With all the components working in tandem with each other it can be seen that, the present invention is a method for extracting nickel and other metals from laterite minerals while reducing the operating costs, capital costs, energy costs and while creating a more environmentally friendly solution.

Although the invention has been explained in relation to its preferred embodiment, it is to be understood that many other possible modifications and variations can be made without departing from the spirit and scope of the invention.

What is claimed is:

1. A method comprising steps of: gathering first laterite minerals; placing first electrodes into a first solution comprising the first laterite minerals; heating the first solution to 75 degrees Celsius; applying a constant current to the first electrodes; shutting off the current; filtering the first solution forming second remaining laterite minerals; wetting the second remaining laterite minerals with dilute hydrogen peroxide; pouring an alkaline solution into the first filtered solution making a second solution; cooling down the second solution at room temperature; cooling down the second solution to 0 degrees Celsius; filtering the second solution; immersing third electrodes into the second filtered solution; and adding additional materials to the second filtered solution.

2. The method as claimed in claim 1, wherein the first electrodes include an anode and cathode.

3. The method as claimed in claim 1, wherein the first solution includes an acid mixture that is one third the amount of ore and water at a 3 to 1 liquid to solid ratio.

4. The method as claimed in claim 1, wherein the first solution includes any one or a mixture selected from the group consisting of sulfuric acid, hydrochloric acid and nitric acid.

5. The method as claimed in claim 1, wherein the first solution includes oxidizers including the dilute hydrogen peroxide.

6. The method as claimed in claim 1, wherein the first electrodes include an electrode made of a stainless-steel material and an electrode made with a platinized titanium material or multi-metal oxide with Ir—Ta coating.

7. The method as claimed in claim 1, wherein the first laterite minerals comprises 1.9% Ni, 25% Fe, 0.05% Co, 3.4% Al, 2.7% Cr, 18% Mg, and 34% Si.

8. The method as claimed in claim 1, wherein the constant current is around 20 $mA/cm^2$ applied for approximately 20 minutes.

9. The method as claimed in claim 1, wherein the alkaline solution is from 10-50% NaOH or CaOH.

10. The method as claimed in claim 1, wherein the alkaline solution is poured at a rate no greater than 5 mL/s.

11. The method as claimed in claim 1, wherein the additional materials includes bismuth, cadmium, indium, tin, lead, ammonium chloride, boric acid and mercury.

12. A method comprising steps of: gathering first laterite minerals; placing a first anode and a first cathode into a first solution comprising the first laterite minerals, the first anode is made with a multi-metal oxide and suppressant salts; heating the first solution to 75 degrees Celsius; applying a constant current to the first anode and the first cathode; shutting off the current; filtering the first solution; pouring an alkaline solution into the first filtered solution making a second solution; cooling down the second solution at room temperature; cooling down the second solution to 0 degrees Celsius; filtering the second solution; immersing a third anode and a third cathode into the second filtered solution; and adding additional materials to the second filtered solution.

13. The method as claimed in claim 12, wherein the first solution includes an acid mixture that is one third the amount of ore and water at a 3 to 1 liquid to solid ratio.

14. The method as claimed in claim 12, wherein the first solution includes any one or a mixture selected from the group consisting of sulfuric acid, hydrochloric acid and nitric acid.

15. The method as claimed in claim 12, wherein the first solution includes oxidizers including hydrogen peroxide.

16. The method as claimed in claim 12, wherein the first laterite minerals comprise 1.9% Ni, 25% Fe, 0.05% Co, 3.4% Al, 2.7% Cr, 18% Mg, and 34% Si.

17. The method as claimed in claim 12, wherein the constant current is around 20 mA/cm2 applied for approximately 20 minutes.

18. The method as claimed in claim 12, wherein the alkaline solution is from 10-50% NaOH or CaOH.

19. The method as claimed in claim 12, wherein the alkaline solution is poured at a rate no greater than 5 mL/s.

20. The method as claimed in claim 12, wherein the additional materials include bismuth, cadmium, indium, tin, lead, ammonium chloride, boric acid and mercury.

* * * * *